US006350563B1

(12) United States Patent
Wichmann et al.

(10) Patent No.: US 6,350,563 B1
(45) Date of Patent: Feb. 26, 2002

(54) PHOTOGRAPHIC BLACK-AND-WHITE REVERSAL FIRST DEVELOPER

(75) Inventors: Ralf Wichmann, Bergisch Gladbach; Ubbo Wernicke, Rösrath, both of (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/156,310

(22) Filed: Nov. 16, 1998

(30) Foreign Application Priority Data

Sep. 26, 1997 (DE) ..... 197 42 490

(51) Int. Cl.[7] ..... G03C 5/305
(52) U.S. Cl. ..... 430/481; 430/486; 430/489
(58) Field of Search ..... 430/481, 486, 430/489

(56) References Cited

U.S. PATENT DOCUMENTS 3,295,975 A 1/1967 Meckl et al. ..... 430/379
4,366,234 A 12/1982 Wheatcroft et al. ..... 430/485
4,419,439 A * 12/1983 Kuwazima et al. ..... 430/375
5,344,741 A 9/1994 Iwata et al. ..... 430/265

* cited by examiner

*Primary Examiner*—Hoa Van Le
(74) *Attorney, Agent, or Firm*—Connolly Bove Lodge & Hutz LLP

(57) ABSTRACT

A photographic black-and-white reversal first developer, which is substantially free from hydroquinone and which contains at least substances a) to d):

a) hydroquinonesulphonic acid, b) a polyglycol with an average molecular weight of 200 to 600, c) an anti-fogging agent, and d) an auxiliary developer, gives clear light regions and high maximum densities after reversal development and can also be used at temperatures considerably above 20° C.

13 Claims, No Drawings

PHOTOGRAPHIC BLACK-AND-WHITE REVERSAL FIRST DEVELOPER

This invention relates to a photographic black-and-white reversal first developer which is substantially free from hydroquinone but which nevertheless provides very good development results. German application No. 197 42 490.2 filed Sep. 26, 1997 is incorporated by reference for all purposes.

Black-and-white reversal development comprises at least the following steps: first development, bleaching, clarifying, second exposure, second development and fixing. In addition, there are usually washing steps between the various chemical baths, a finishing bath and a drying step.

During the development of black-and-white reversal films, first developers are generally used which contain mixtures of hydroquinone/phenidone or hydro-quinone/metol as the developing substances.

However, hydroquinone is undesirable for health-related and environmental reasons. The object was therefore to identify a developer which is free from hydroquinone. In this respect, the object was to replace hydroquinone as a developing substance in a first developer of a black-and-white reversal process, without having to accept differences in the resulting image which are far too great.

The black-and-white first development of the reversal process is usually conducted at 20° C. So as to be able to maintain this low temperature, cooling with cold water has to be employed, particularly in hot seasons and in hot countries. This results in high costs and in an unwanted waste of cooling water.

It is not possible to use the known black-and-white first developer at higher temperatures, since this results in an altered gradation curve and in considerably reduced maximum densities, due to subsequent development and due to a considerable increase in fogging during first development.

A second object was therefore to make black-and-white first development possible at higher temperatures.

In the reversal process, the gradation for a reversal film is fixed during first development. A good gradation during first development results in quite clear light regions and high maximum densities after reversal development.

For this purpose it is necessary that in the first development step (in contrast to pure negative development) complete development throughout is achieved of the exposed silver halide grains, so that completely clear light regions are obtained after reversal development.

At the same time, the first development must not be too active and thereby result in an increase in fogging, since this results in decreased maximum densities after reversal development.

Compounds such as amidol, catechol, hydroquinonesulphonic acid or ascorbic acid are known as alternative developer substances instead of hydroquinone in black-and-white developers.

However, the simple replacement of hydroquinone by one of these substances leads to considerably inferior results.

Surprisingly, it has now been found that the replacement of hydroquinone by hydroquinonesulphonic acid results in a developer of good quality if the black-and-white reversal first developer contains certain other substances.

The present invention therefore relates to a photographic black-and-white reversal first developer which is substantially free from hydroquinone, characterised in that it contains at least the following substances a) to d):

a) hydroquinonesulphonic acid, b) a polyglycol with a weight average molecular weight of 200 to 600, c) an anti-fogging agent, and d) an auxiliary developer.

A polyethylene glycol with a weight average molecular weight of 200 to 400 (denoted as P 200 or P 400) is preferably used as the polyglycol.

5-alkylbentriazoles such as 5-ethyl- and 5-propylbenztriazole, particularly 5-methyl-benztriazole, are preferably used as anti-fogging agents.

4,4-dimethyl-1-phenyl-3-pyrazolidone (dimezone), 4-methyl-4-hydroxymethyl-1-phenyl-3-pyrazolidone (dimezone S), 1-phenyl-3-pyrazolidone (phenidone) or 4-methyl-1-phenyl-3-pyrazolidone (phenidone Z) are preferably used as auxiliary developers.

The photographic black and white reversal first developer is characterized in that in the ready to use developer the hydroquinonesulphonic acid is a) used in the concentration of 0.01 to 0.5 moles/1, b) the polyglycol is used in a concentration of 0.1 to 15 g/l, c) the anti-fogging agent is used in a concentration of $1\times10^{-6}$ to $3\times10^{-3}$ moles/l, and d) the auxiliary developer is used in a concentration of 0.001 to 0.05 moles/l.

In addition, the photographic black-and-white reversal first developer additional can contain a water-soluble rhodanide which can be used in amounts of $1\times10^{-3}$ to $1\times10^{-1}$ moles/l. The invention further describes a process for the reversal development of exposed black-and-white materials comprising at least the steps of the first development, bleaching, clarifying, second exposure, second development and fixing, and wherein a developer is used as the first developer which is substantially free from hydroquinone and which contains the following substances a) and d):

a) hydroquinonesulphonic acid, b) a polyglycol with a weight average molecular weight of 200 to 600, c) an anti-fogging agent, and d) an auxiliary developer.

This process is carried out wherein the primary development is conducted at 24 to 38° C.

The expression "substantially free from hydroquinone" means that the black-and-white reversal first developer according to the invention contains less than 10% of the amount which was customary hitherto. The developer according to the invention is preferably free from hydroquinone.

EXAMPLES 1 TO 6

A commercially available black-and-white reversal film, e.g. that of film speed 200 supplied by Agfa-Gevaert AG, was exposed using a grey step wedge and was processed, washed and dried in the following baths.

| | |
|---|---|
| first development | 20° C./6 min |
| 1st washing | 20° C./2 min |
| bleaching bath | 20° C./2 min |
| 2nd washing | 20° C./4 min |
| clarifying bath | 20° C./4 min |
| 3rd washing (with second exposure) | 20° C./2 min |
| second developer | 20° C./4 min |

-continued

| | |
|---|---|
| 4th washing | 20° C./2 min |
| fixing bath | 20° C./4 min |
| 5th washing | 20° C./4 min |
| finishing bath | 20° C./2 min |

In order to assess fogging (clarity of the light regions) and the maximum densities attainable, all the grey step wedges were adjusted to a common sensitivity, which can be determined by a measured mean density (MD field) by varying the time of development or the temperature of first development. Due to this procedure, all the developments performed were comparable with each other, so that the different effects of the compounds used could be assessed.

In order to assess the clarity of the light regions, the 6th field from the MD field in the direction of the background fogging was measured. The maximum density obtained was measured as a second important criterion.

A typical development procedure in a commercially available black-and-white first developer containing hydroquinone was employed as a (type) reference.

A positive difference in the 6th measuring field compared with the reference denoted an inferior image result due to too slight an extent of complete development in the shadow region during first development.

A negative difference with respect to the maximum density indicated reduced maximum densities (caused by an increases in fogging during first development) and therefore also resulted in inferior image results (no clear light regions).

| Examples | B/W first developer | Processing temperature | Density difference in 6th measuring field | Maximum density |
|---|---|---|---|---|
| 1 Reference | commercially available first developer containing hydroquinone | 20° C. | — | 270 |
| 2 | first developer from the AP 44 or E6 process | 20° C. | +25 | −5 |
| 3 | first developer from the AP 44 or E6 process | 30° C. | +20 | −35 |
| 4 | first developer from the AP 44 or E6 process | 40° C. | +15 | −60 |
| 5 | new D1 | 20° C. | +20 | −6 |
| 6 | new D1 | 30° C. | +16 | −10 |

Developers used (1 liter tank solution);

1. Commercially Available First Developer Containing Hydroquinone
   - 4.5 g hydroquinone
   - 11.0 g potassium sulphite
   - 41.7 g potassium carbonate
   - 1.5 g sodium carbonate
   - 5.5 g potassium hydroxide
   - 2.0 g nitrilotriacetic acid
   - 1.6 g potassium bromide
   - 67 mg benztriazole
   - 3.8 g N-methyl-4-aminophenyl-hydrogen sulphate (metol)
   - 0.4 ml hydroxyethane-diphosphonic acid
   - 1.2 g polyethylene glycol, molecular weight 1500
   - 2.0 g sulphuric acid
     made up with water; pH 10.2
2. first developer in the E-6 process
   - 22 g potassium salt of hydroquinonesulphonic acid
   - 28.6 g potassium sulphite
   - 3.3 g potassium hydroxide
   - 1.4 g dimezone S
   - 12.0 ml diethylene glycol
   - 14.0 g potassium carbonate
   - 5.0 ml solution of the Na salt of diethylenetriaminepentaacetic acid
   - 2.2 g sodium bromide
   - 1.0 g sodium rhodanide
   - 4.4 mg potassium iodide
   - 0.8 ml aminotrismethylene-phosphonic acid
   - 12.0 g sodium hydrogen carbonate
     made up with water; pH 9.65
3. New D-1 developer
   - 19.5 g potassium salt of hydroquinonesulphonic acid
   - 40.0 g potassium sulphite
   - 3.8 g potassium hydroxide
   - 1.25 g dimezone S
   - 10.0 ml diethylene glycol
   - 21.7 g potassium carbonate
   - 4.2 ml solution of the sodium salt of diethylenetriaminepentaacetic acid
   - 5.0 g potassium bromide
   - 10 g sodium hydrogen carbonate
   - 0.7 ml aminotrismethylene-phosphonic acid
   - 0.8 g sodium rhodanide
   - 1.0 mg potassium iodide
     made up with water; pH 10.0.

As shown by examples 5 and 6, the new first developer still did not result in satisfactory levels of clarity, since development throughout in the first developer was still always unsatisfactory and thus resulted in too high a level of fogging after reversal development.

A possible way was therefore sought of considerably improving the development throughout during first development, in order to obtain clear light regions after reversal development.

It is known that the activity of the developer can be increased by increasing the temperature, increasing the pH, by higher concentrations of sulphite or carbonate, or by the addition of suitable development accelerators.

Since, of these measures, an increase in the temperature proved to be a suitable measure for improving development throughout, all further investigations were performed at a development temperature of about 30° C.

Surprisingly, it was found that only the addition of polyglycols as development accelerators resulted in a considerably improved complete development of the shadow region after first development, and thus resulted in an improvement in the clarity of the light regions after reversal development.

Apart from this advantage, however, it proved to be a disadvantage when using polyglycols that almost all the polyglycols, when used in the requisite amounts, resulted in significantly reduced maximum densities after reversal development.

As shown in examples 6 to 12, compared with polyethylene glycols P1000, P1500, P4000 and P12000 the use of polyethylene glycols P200 and P400 resulted in the lowest loss of maximum density, so that P200 and P400 appeared to be the most suitable for this developer. All further investigations were therefore performed using P400 as the development accelerator.

EXAMPLES 6 TO 12

The processing conditions and the film material corresponded to the conditions of examples 1 to 6. In the examples, the new first developer (D1) was used at a processing temperature of about 30° C.

| Example | Development accelerator used | Density difference in 6th measuring field | Maximum density |
|---|---|---|---|
| 6 | new D1 without development accelerator | +25 | −1 |
| 7 | 0.5 g/l P4000 | +2 | −81 |
| 8 | 0.5 g/l P1500 | +3 | −74 |
| 9 | 0.5 g/l P1000 | +7 | −37 |
| 10 | 2 g/l P400 | −3 | −22 |
| 11 | 2 g/l P200 | −1 | −18 |
| 12 | 4 g/l P400 | −6 | −32 |

After success was achieved in obtaining development throughout in the shadow region in first development and therefore of obtaining clear light regions after reversal development, attempts were made to increase the reduced maximum densities which were associated with the measures carried out.

Surprisingly, it has now been found that the use of 5-methylbenzotriazole in combination with polyglycol P400 and hydroquinonesulphonic acid resulted in the desired gradation curve and in usable image results.

As shown in examples 12 to 22, almost all the anti-fogging agents and stabilisers tested resulted in unusable gradation curves and image results after they were added to the new hydroquinone-free first developer in combination with P400, since they a) either had too strong a stabilising effect and thus also prevented complete development in the first development stage (which resulted in no clear light regions again), or b) had too slight a stabilising effect and thereby resulted as before in maximum densities which were too low.

As can be seen from examples 21 and 22, the use of 5-methylbenzotriazole in combination with P400 surprisingly resulted in good stabilisation of the maximum densities, and even resulted in an increase in maximum densities with good image results (clear light regions) being obtained at the same time.

EXAMPLES 12 TO 22

The processing conditions and film material corresponded to the conditions of examples 1 to 6. In the examples, the new developer (D1) was used at a processing temperature of about 30° C.

| Example | Anti-fogging agent used in new D1 | Density difference in 6th measuring field | Maximum density |
|---|---|---|---|
| 12 | 4 g/l P400 without additional anti-fogging agent | −6 | −32 |

-continued

| Example | Anti-fogging agent used in new D1 | Density difference in 6th measuring field | Maximum density |
|---|---|---|---|
| 13 | 2 g/l P400<br>60 mg/l 5-nitrobenzimidazole | +5 | −10* |
| 14 | 2 g/l P400<br>50 ml/l benzotriazole | +5. | −60 |
| 15 | 2 g/l P400<br>1 g/l 4-methyl-5-methoxy-carbonylbenztriazole | +20 | +3 |
| 16 | 2 g/l P400<br>50 mg/l aminothiazole | +8 | −55 |
| 17 | 2 g/l P400<br>50 mg/l imidazole | +8 | −50 |
| 18 | 2 g/l P400<br>3 g/l KBr<br>13 mg/l KI | +15 | −20 |
| 19 | 2 g/l P400<br>50 mg 5-methylbenzotriazole | +10 | +10 |
| 20 | 2 g/l P400<br>30 mg/l 1-phenyl-5-mercaptotetrazole | +25 | +10 |
| 21 | 4 g/l P400<br>50 mg 5-methylbenzotriazole | −2 | −5 |
| 22 | 4 g/l P400<br>100 mg 5-methylbenzotriazole | +1 | +20 |

*unusable, since points of the same density occurred in the gradation curve at different exposures.

The other baths had the following compositions (given per liter in each case):

| | |
|---|---|
| | Bleaching bath |
| 10.0 g | potassium dichromate |
| 120 ml | 20% by weight sulphuric acid |
| — | made up with water; pH 1.0 |
| | Clarifying bath |
| 2.0 g | ethylenediaminetetraacetic acid, tetrasodium salt |
| 100 g | sodium sulphite |
| — | made up with water; pH 8.0 |
| | Second developer |
| 2.0 g | ethylenediaminetetraacetic acid, tetrasodium salt |
| 20 g | sodium sulphite |
| 6.0 g | hydroquinone |
| 0.5 g | phenidone |
| 10 ml | diethylene glycol |
| 30 g | potassium carbonate |
| 5.0 g | potassium hydroxide |
| 1.0 g | potassium bromide |
| — | made up with water; pH 11.0 |
| | Fixing bath |
| 90 g | ammonium thiosulphate |
| 2.0 g | ethylenediaminetetraacetic acid, tetrasodium salt |
| 12.0 g | sodium sulphite |
| — | made up with water; pH 7.5 |
| | Finishing bath |
| 0.5 g | formaldehyde |
| 0.5 g | polyoxyethylene p-monononyl ether |
| — | made up with water; pH 7.0 |

What is claimed is:

1. A photographic black-and-white reversal first developer which is substantially free from hydroquinone, which comprises at least the following substances a) to d):

a) hydroquinonesulphonic acid, b) a polyglycol with a weight average molecular weight of 200 to 600.

c) an anti-fogging agent, and d) an auxiliary developer.

2. The photographic black-and-white reversal first developer according to claim 1, wherein said polyol is polyethylene glycol, said anti-fogging agent is 5-methylbenztriazole and said auxiliary developer is 4,4-dimethyl-1-phenyl-3-pyrazolidone or 4-methyl-4-hydroxymethyl-1-phenyl-3-pyrazolidone.

3. The photographic black-and-white reversal first developer according to claim 1, wherein a) the hydroquinonesulphonic acid is used in a concentration of 0.01 to 0.5 moles/l, b) the polyglycol is used in a concentration of 0.1 to 15 g/l, c) the anti-fogging agent is used in a concentration of $1\times10^{-6}$ to $3\times10^{-3}$ moles/l, and d) the auxiliary developer is used in a concentration of 0.001 to 0.05 moles/l.

4. The photographic black-and-white reversal first developer according to claim 1, further comprising a water-soluble rhodanide.

5. The photographic black-and-white reversal first developer according to claim 4, wherein the rhodanide is present in amounts from $1\times10^{-3}$ to $1\times10^{-1}$ moles/l.

6. A process for the reversal development of exposed black-and-white materials comprising at least the steps of first development, bleaching, clarifying, second exposure, second development and fixing, and wherein a developer is used as the first developer which is substantially free from hydroquinone and which contains the following substances a) and d):

a) hydroquinonesulphonic acid, b) a polyglycol with a weight average molecular weight of 200 to 600, c) an anti-fogging agent, and d) an auxiliary developer.

7. The process according to claim 6, wherein said first development is conducted at 24 to 38° C.

8. The photographic black-and-white reversal first developer according to claim 1, wherein said anti-fogging agent is 5-ethyl-benztriazole, 5-propyl-benztriazole or 5-methyl-benztriazole.

9. A photographic black-and-white reversal first developer which is substantially free from hydroquinone, which comprises at least the following substance a) to d):

a) hydroquinonesulphonic acid, b) a polyethylene glycol with a weight average molecular weight of 200 to 600.

c) an anti-fogging agent selected from the group consisting of 5-ethyl-benztriazole, 5-propyl-benztriazole or 5-methyl-benztriazole, d) an auxiliary developer.

10. The photographic black-and-white reversal first developer according to claim 9, wherein said anti-fogging agent is 5-methylbenztriazole and said auxiliary developer is 4,4-dimethyl-1-phenyl-3-pyrazolidone or 4-methyl-4-hydroxymethyl- 1-phenyl-3-pyrazolidone.

11. The photographic black-and-white reversal first developer according to claim 9, wherein a) the hydroquinonesulphonic acid is used in a concentration of 0.01 to 0.5 moles/l, b) the polyethyleneglycol is used in a concentration of 0.1 to 15 g/l, c) the anti-fogging agent is used in a concentration of $1\times10^{-6}$ to $3\times10^{-3}$ moles/l, and d) the auxiliary developer is used in a concentration of 0.001 to 0.05 moles/l.

12. The photographic black-and-white reversal first developer according to claim 9, further comprising a water-soluble rhodanide.

13. The photographic black-and-white reversal first developer according to claim 12, wherein the rhodanide is present in amounts from $1\times10^{-3}$ to $1\times10^{-1}$ moles/l.

* * * * *